US005343640A

United States Patent [19]

Mattiuzzo et al.

[11] Patent Number: 5,343,640

[45] Date of Patent: Sep. 6, 1994

[54] SKI BOOT

[75] Inventors: Mario Mattiuzzo, Treviso; Alessandro Condini, Trento, both of Italy

[73] Assignee: Lange International S.A., Fribourg, Switzerland

[21] Appl. No.: 10,592

[22] Filed: Jan. 28, 1993

[30] Foreign Application Priority Data

Jan. 28, 1992 [CH] Switzerland ..... 234/92-2

[51] Int. Cl.[5] ..... A43B 5/04

[52] U.S. Cl. ..... 36/121; 36/120

[58] Field of Search ..... 36/117, 118, 119, 120, 36/121

[56] References Cited

U.S. PATENT DOCUMENTS

| | | | |
|---|---|---|---|
| 3,848,347 | 11/1974 | Hanson et al. | 36/2.5 AL |
| 4,073,073 | 2/1978 | Seidel | 36/50 |
| 4,372,061 | 2/1983 | Pozzobon | 36/117 |
| 4,998,358 | 3/1991 | Girardelli | 36/117 |
| 5,001,849 | 3/1991 | Bidoia | 36/117 |
| 5,054,215 | 10/1991 | Tonel et al. | 36/117 X |
| 5,175,948 | 1/1993 | Tonel et al. | 36/117 |

FOREIGN PATENT DOCUMENTS 2358848 2/1978 France .

*Primary Examiner*—Paul T. Sewell
*Assistant Examiner*—BethAnne C. Cicconi
*Attorney, Agent, or Firm*—Kane, Dalsimer, Sullivan, Kurucz, Levy, Eisele & Richard

[57] ABSTRACT

Ski boot made of plastic material comprising a rigid shell (1), on which a collar (2) is articulated and which is provided with clamping members. The collar (2) has at the rear a slit (11), the opening of which is adjustable by means of a rigid rider (30) inserted into notches (20, 21) provided on each side of the lips. This adjustment is intended for adapting the boot to the morphology of the calf of the skier while ensuring a firm backward lean.

7 Claims, 3 Drawing Sheets

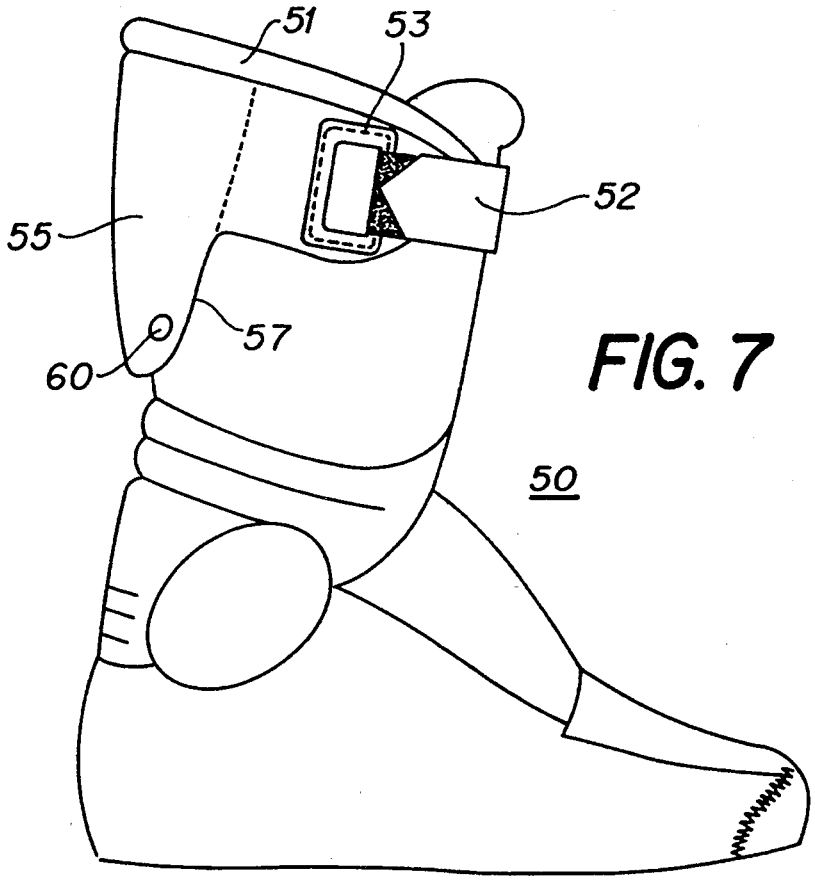
FIG. 7
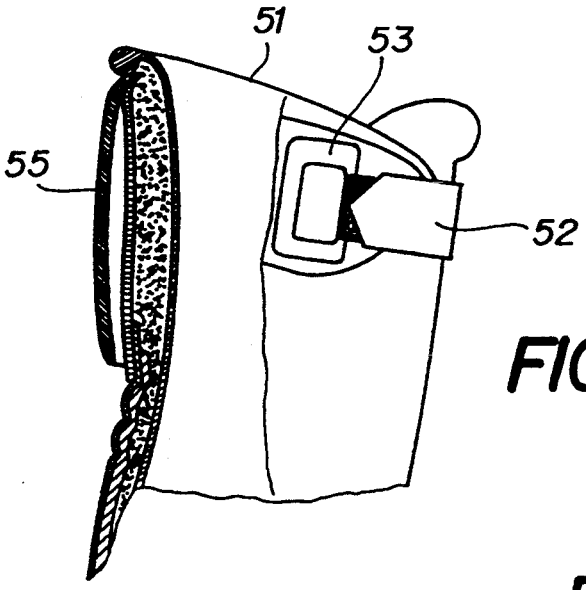
FIG. 8
FIG. 9
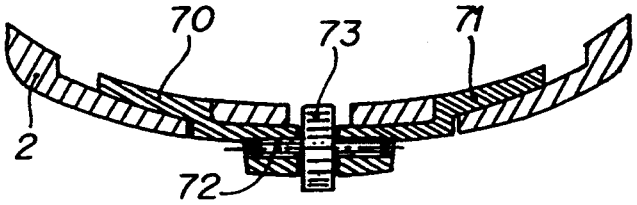

SKI BOOT

FIELD OF THE INVENTION

The invention relates to a ski boot made of plastic material comprising a rigid shell intended to receive an inner boot, into which the foot of the skier is inserted, a shaft articulated on the shell, members for clamping the foot in the shell and the lower leg in particular in the region of the top of the shaft, and in which the rear of the shaft has at least one slit which forms two lips, opens on the top of the shaft and the opening of which is adjustable.

The shaft can be made in one or two parts. It can take the form of a single collar which is open on the front and comprises clamping members, or of a collar, known as a rear entry collar, which is made in two parts, namely a front cuff and a rear cuff.

PRIOR ART

It is known that the shape and the position of the calves vary on the one hand according to sex and on the other hand according to ethnic group. It follows that, since the calves are more or less large, more or less round and more or less high, the boots exhibit difficulties in providing homogeneous clamping of the lower leg and, consequently, depending on the case, cause not inconsiderable pain during skiing.

In document EP-A-0 371 915 of the applicant, it was proposed to arrange on the upper part of the rear of the collar an articulated and adjustable support element for the calf, intended to adapt the upper part of the shaft to the shape of the calf, the upper rear part of the collar then having an indentation covered by said adjustable articulated element. This solution, however, has the disadvantage of causing a break in continuity of the support between the rear of the collar and the rear of the support piece, in the region of the articulation of the articulated support element, a break which in the end also causes pain, which results in a lack of safety during skiing (see also EP-A-0 342 463).

In the document U.S. Pat. No. 3,936,959, it was proposed to arrange on the top of the rear of the collar a slit, around which a slide slides, which is intended to adjust the height of the residual opening of the slit. This solution, which makes it possible to adjust in a satisfactory manner the adaptation of the top of the collar to the morphology of the lower calf, does not, however, make it possible to ensure during skiing adequate clamping, in particular during backward leans, since in use the slide always tends to slide downwards. In fact, this solution essentially makes it possible, like all slits arranged at the rear of a collar, to impart flexibility to the top part of the rear of the collar, and thus to avoid cutting contacts against the lower calf.

From document FR-A-2 358 848, a ski boot is known which has at the rear a wide indentation, the height and the width of which are adequate to make possible free inclination of the leg of the skier towards the rear, a support element in the form of a bridge being fixed straddling the indentation and at an adjustable height in order to limit at will the inclination of the leg towards the rear. This construction certainly makes possible an adaptation of the shaft of the boot to the morphology of the skier but at the cost of the rigidity which becomes completely inadequate for good skiing. The support on the bridge is moreover not very stable.

SUMMARY OF THE INVENTION

The invention avoids these disadvantages. It relates to a ski boot of the type defined above, which makes it possible to adjust the diameter of the top of the collar to the exact morphology of the calf of the skier, while ensuring firm backward leans.

According to an advantageous embodiment of the invention, the boot comprises a plurality of riders of different widths, which allow a choice making it possible to adopt the appropriate clamping, the rider has the general shape of a flattened omega having tabs connected to vertical walls, then to a connection portion which gives the width proper, the lips of the slit having on each side a notch formed by an opening, through which the tabs of the rider pass to come to be accommodated against the internal wall of the collar or of the rear cuff, and a stop which is arranged in the vicinity of the lip and interacts with the vertical walls of the rider forming a brace.

The tabs of the rider can moreover have lugs which are parallel to the vertical walls and are intended to interact with the stops to give different widths.

The rider can be adjustable in width.

The slit can have on each side two parallel notches arranged one above another.

The collar can have at the rear a plurality of slits arranged in a corolla.

The rear of the inner boot preferably covers the slit(s) to ensure the impermeability thereof.

BRIEF DESCRIPTION OF THE DRAWINGS

The attached drawing shows by way of example an embodiment of the boot according to the invention.

FIG. 7 shows, seen from the side, an inner boot adapted to the boot, the height of which inner boot is shown in section in FIG. 8.

FIG. 9 shows a rider of adjustable width.

DESCRIPTION OF THE PREFERRED EMBODIMENTS

Figure 1:
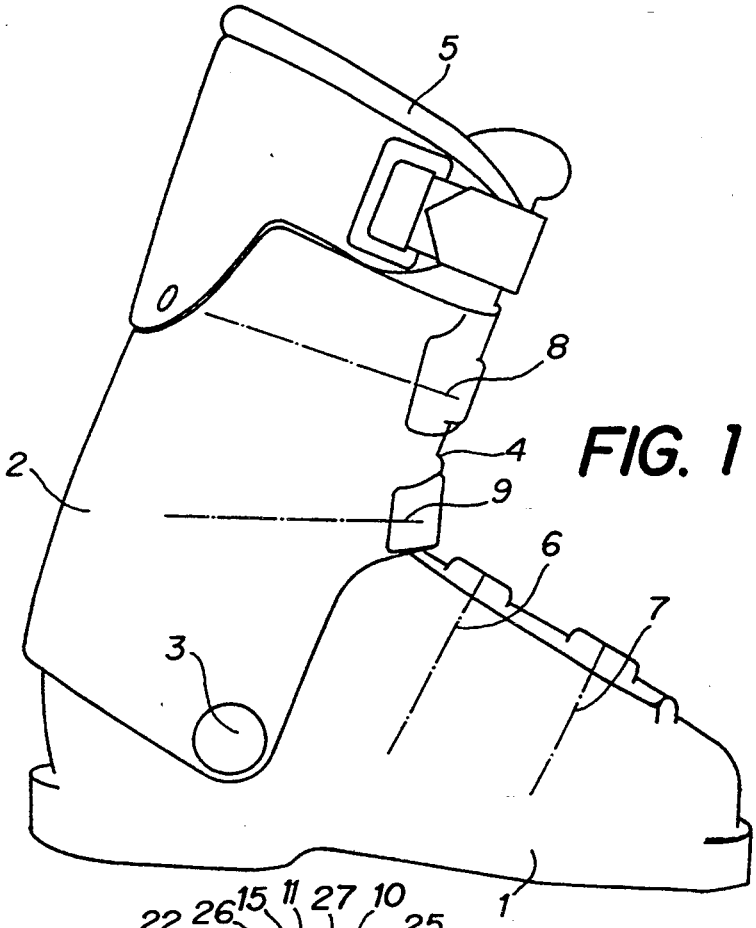
FIG. 1 shows in side view a ski boot according to the invention.

The ski boot shown comprises a rigid shell designated by the general reference 1 and a shaft in the form of a collar 2 articulated at 3 in the region of the ankles and made in one part which is open at the front 4 to allow the introduction of the foot and, more specifically, of an inner boot 5 into the shell 1. In known manner, the boot comprises members for clamping the foot in the shell and the lower leg on the collar respectively, which are indicated diagrammatically by the dot/dash lines 6, 7, 8, 9.

Figure 2:
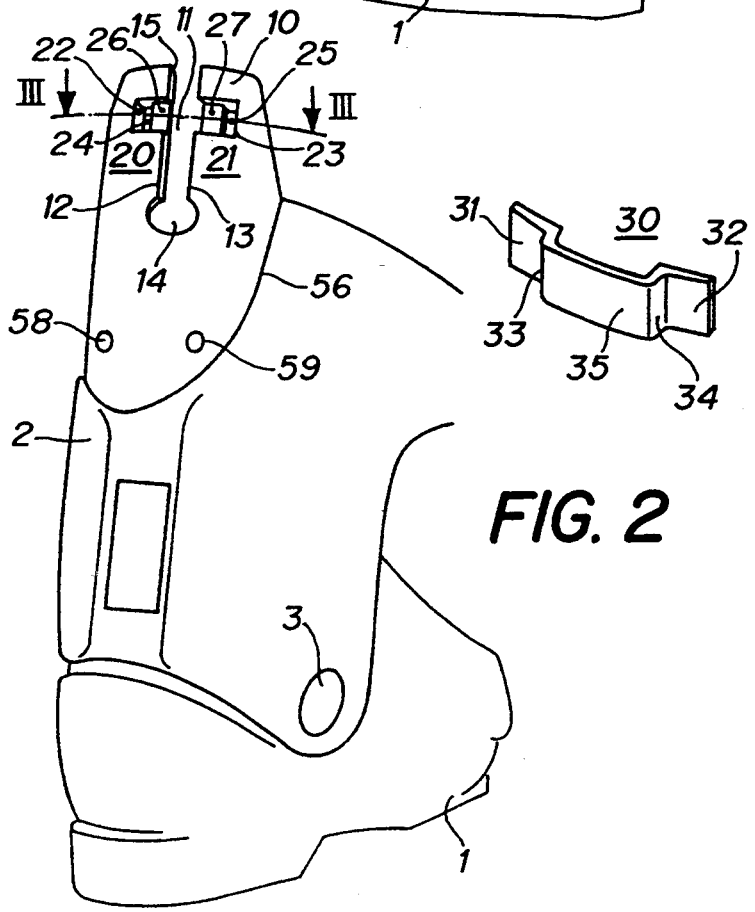
FIG. 2 shows in rear three-quarter view the characteristic elements of the invention.

The top 10 of the collar 2 (see FIG. 2) has a slit 11 forming two parallel lips 12 and 13 respectively which end towards the bottom in a rounding 14. The slit 11 opens at 15 essentially in the middle of the rear of the collar 2.

The slit 11 has on the top, on both sides of the two parallel lips 12, 13, a notch, 20 and 21 respectively, formed, from the lip, by a stop 22, 23, by an opening 24, 25 associated therewith and by a bearing surface 26, 27.

Figure 3:
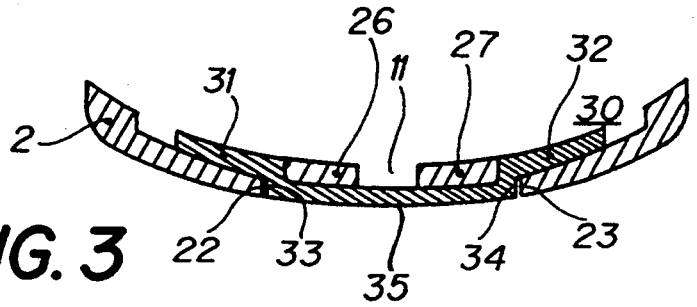
FIG. 3 shows a section along the axis III—III in FIG. 2.

The boot comprises a rider designated by the reference 30, preferably made of rigid plastic material, in the general form of a flattened omega, which consists of two tabs, 31, 32 respectively, intended to be inserted into the openings 24, 25 to come to be accommodated and applied against the inner wall of the collar 2 (see FIG. 3). These tabs 31, 32 are connected by vertical walls 33, 34 to a connection portion 35 forming the width proper. As can be seen in FIG. 3, the vertical walls 33, 34 of the rider inserted into the openings 24, 25 of the collar form braces and come to interact with the stops 22, 23 and the bearing surfaces 26, 27 to adjust thus the opening of the slit 11. By virtue of the rigid connection portion 35, a constant width of the slit 11 and a firm backward lean are obtained during skiing. It will be noted that the total thickness of the rider is practically equal to the thickness of the collar and that the rider comes to be integrated into the thickness of the collar in such a manner that there is virtual continuity of the collar in the region of the rider.

Starting from a plurality of riders of different lengths, by a choice of connection 35 of appropriate length, it is possible to adjust in an accurate manner the diameter of the top of the collar 2 to the exact morphology of the calf of the skier.

It will be understood that the opening of the slit 11 adapted to the dimension of the calf remains constant, even during backward leans, which would not have been possible in the previous solutions, in particular in those described in the document U.S. Pat. No. 3 936 959.

Similarly, in contrast to the previous solutions, in particular those in the three documents EP-A-0 342 463, EP-A-0 371 915 and FR-A-2 358 848, the rear of the lower leg bears permanently and homogeneously against the entire rear face of the collar, and without a break.

Figure 4:
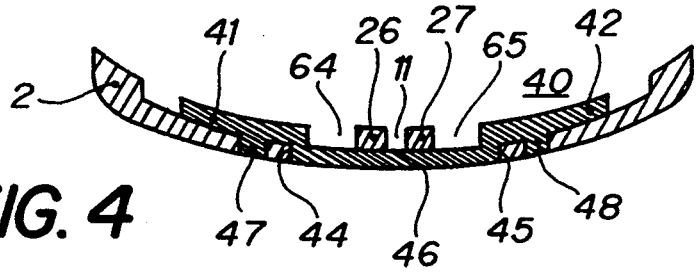
FIGS. 4 and 5 show an alternative embodiment according to a section similar to that shown in FIG. 3.
Figure 5:
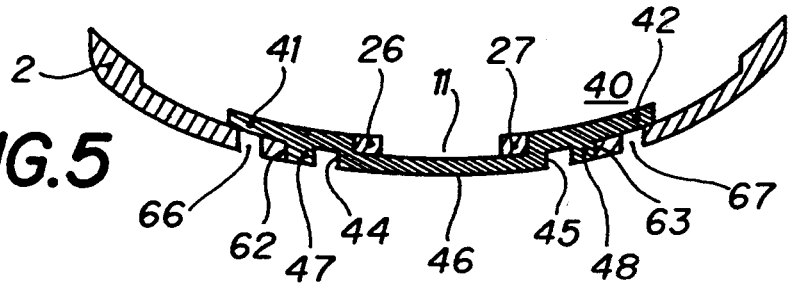

In the alternative embodiment shown in FIGS. 4 and 5, the notches 20 and 21 of the collar have openings 64 and 65 which are wider than the openings 24 and 25, these notches defining stops 62, 63. Provided on both sides of the openings 62 and 63 are housings 66 and 67. The rider, designated here by the reference 40, has tabs 41, 42 which are associated, via vertical walls 44, 45 forming braces, with a connection portion 46. This collar 40 moreover has two lugs 47, 48 which are parallel to the vertical walls 44, 45 and spaced from the latter by a distance at least equal to their thicknesses. This form of rider 40 thus allows two different width adjustments which are shown in FIG. 4 and in FIG. 5 respectively.

In the position shown in FIG. 4, the vertical walls 44 and 45 bear against the stops 62 and 63 and the lugs 47 and 48 are engaged in the housings 66 and 67. The slit 11 is not very wide.

In the position shown in FIG. 5, the lugs 47 and 48 are engaged in the openings 64 and 65 and bear against the stops 62 and 63. The slit 11 is open wide.

It can also be seen that in this embodiment the slit 11 has certainly varied but remains of constant width during skiing.

Figure 6:
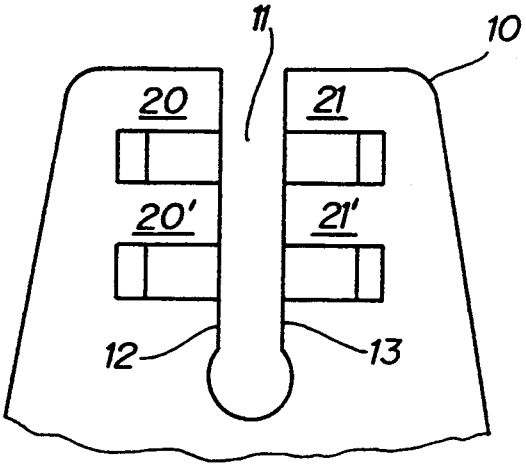
FIG. 6 shows an alternative embodiment of the notches.

In the embodiment shown in FIG. 6, the top 10 of the collar has two sets of parallel notches 20, 21 and 20', 21' situated one above another on the edges of the lips 12, 13.

FIGS. 7 and 8 show an inner boot 50 adapted to the boot described. In known manner, the top 51 of this inner boot 50 has a clamping band 52 which interacts with a buckle 53. In known manner, the rear and the top of the inner boot have a flap 55 intended to come to cover the top 10 of the rear of the collar 2 and thus ensure a good connection between the collar 2 and the inner boot 50. To do this, the top of the rear face of the collar 2 has a housing 56 (see FIG. 2), into which there comes to be inserted the edge 57 of the flap 55 which is fixed by press buttons 60 in complementary parts 58, 59 provided to this end on the rear of the collar 2. Thus, this otherwise known flap 55 makes it possible to ensure a new function of impermeability of the slit 11.

The rider could itself be of adjustable width. An exemplary embodiment is shown in FIG. 9. The rider consists of two parts 70 and 71 connected by a screw 72 having, on each side of a knurled wheel 73, threads in opposite directions (left-handed and right-handed). For the rest, this rider is similar to the rider 30.

Instead of a rider in the form of a flattened omega, it would be possible to use a U-shaped rider put in place from the inside of the collar in such a manner that it is held in place by the inner boot.

The boot is a boot known as a "conventional-entry" boot. It is clear that, without leaving the scope of the invention, the boot can be of the rear-entry type, that is to say the type in which the collar is made not in one but in two parts, a front cuff and a rear cuff respectively, articulated on the shell. This can also be a boot known as a combined-entry boot.

The ski boot according to the invention has numerous advantages in relation to those marketed today and those described in the prior art. Mention can be made of:

- the possibility of adjusting easily and in a fixed manner the dimensions of the top of the collar to the exact morphology of the calf of the skier, it being possible even for the adjustment to be different from one boot to the other;
- the possibility of ensuring, during skiing, a firm and comfortable backward lean while maintaining good support of the rear of the collar against the entire lower leg, which ensures better steering of the ski and above all excellent comfort;
- finally, good impermeability of the boot.

We claim:

1. A ski boot made of plastic material comprising:

a rigid shell intended to receive an inner boot, into which to foot of the skier having a certain morphology of the skier's calf, is inserted, a shaft articulated on the shell, and having a top and a rear, and a wall having a certain thickness, the top having an adjustable diameter, means for clamping the foot in the shell and the lower leg in the region of the top of the shaft, the rear of the shaft having at least one slit having two lips and an opening therebetween and being open on the top of the shaft, the opening being adjustable, notches on each side of he lips of the slit, a rigid rider having adjusting means for assuring the continuity of the shaft wall and for adjusting the width of the opening of the slit inserted into the notches, the adjusting means serving to adjust the diameter of the top of the shaft to the morphology of the calf of the skier, while ensuring a backward lean which is form in position.

2. The ski boot as claimed in claim 1, wherein the rider has a total thickness, the total thickness of the rider is at least approximately equal to the thickness of the wall of the shaft of the boot.

3. The ski boot as claimed in claim 1, wherein the means for assuring the continuity of the shaft wall has two vertical walls and tabs connected to the two vertical walls, a connected portion connected to the walls and forms the width of the opening of the slit, the rider having a flattened omega shape, each of the notches having an opening through which a tab of the rider passes, each tab being accommodated against the wall of the shaft, a stop arranged in the vicinity of the lip and which interacts with the vertical walls of the rider forming a brace, the shaft having a bearing surface and the connection portion accommodated against the bearing surface.

4. The ski boot as claimed in claim 3, wherein the shaft has stops and housings on each side of the notches, the tabs of the rider having lugs which are parallel to the vertical walls of the rider and adapted to interact with the stops to give the slit another width, the lugs coming to be accommodated in said housings when they are not interacting with the stops.

5. The ski boot as claimed in claim 1, wherein the rider has means to adjust its width.

6. The ski boot as claimed in claim 1, which has two parallel notches arranged one above another on each side of the slit.

7. The ski boot as claimed in claim 1, wherein an inner boot is in the shell and has a rear, the rear of the inner boot covers the slit to ensure the impermeability thereof.

* * * * *